US007983432B2

(12) United States Patent
Grinnip, III

(10) Patent No.: US 7,983,432 B2
(45) Date of Patent: Jul. 19, 2011

(54) POINT EXCITATION PLACEMENT IN AN AUDIO TRANSDUCER

(75) Inventor: Roger Stephen Grinnip, III, Lake Zurich, IL (US)

(73) Assignee: Shure Acquisition Holdings, Inc., Niles, IL (US)

( * ) Notice: Subject to any disclaimer, the term of this patent is extended or adjusted under 35 U.S.C. 154(b) by 1328 days.

(21) Appl. No.: 11/536,829

(22) Filed: Sep. 29, 2006

(65) Prior Publication Data

US 2008/0080735 A1 Apr. 3, 2008

(51) Int. Cl.

| | |
|---|---|
| ***H04R 25/00*** | (2006.01) |
| ***H04R 1/00*** | (2006.01) |
| ***H04R 9/06*** | (2006.01) |
| ***H04R 11/02*** | (2006.01) |
| ***H04R 7/00*** | (2006.01) |
| ***G10K 13/00*** | (2006.01) |

(52) U.S. Cl. ..... 381/152; 381/418; 381/423; 181/161

(58) Field of Classification Search ..... 181/161, 181/164; 381/152, 161, 162, 388, 191, 417, 381/418

See application file for complete search history.

(56) References Cited

U.S. PATENT DOCUMENTS

| | | | | |
|---|---|---|---|---|
| 6,243,473 | B1 * | 6/2001 | Azima et al. | 381/152 |
| 6,694,038 | B1 * | 2/2004 | Azima | 381/152 |
| 2002/0044668 | A1 | 4/2002 | Azima | |
| 2002/0191803 | A1 * | 12/2002 | Asada et al. | 381/152 |
| 2005/0018865 | A1 * | 1/2005 | Azima et al. | 381/190 |

FOREIGN PATENT DOCUMENTS

| | | | |
|---|---|---|---|
| GB | 931080 | A | 7/1963 |
| JP | 57065094 | A | 4/1982 |
| WO | WO97/09842 | * | 3/1997 |
| WO | 00 70909 | | 11/2000 |
| WO | 03001841 | A2 | 1/2003 |
| WO | 2005041616 | A1 | 5/2005 |
| WO | 2005053355 | A2 | 6/2005 |

OTHER PUBLICATIONS

International Search Report for PCT/US 2007/079280, dated Apr. 4, 2008, pp. 1-2.

Office Action in related European Application No. 07 843 049.4, dated Jul. 21, 2010, pp. 1-5.

* cited by examiner

*Primary Examiner* — Curtis Kuntz
*Assistant Examiner* — Jesse A Elbin
(74) *Attorney, Agent, or Firm* — Banner & Witcoff, Ltd.

(57) ABSTRACT

The present invention provides methods and apparatuses for an audio transducer. The audio transducer is excited by driving a paddle of a diaphragm. A plurality of node regions of a paddle is determined for the higher-order modal components, which correspond to resonance frequencies and have an order greater than one. An intersection region of at least two higher-order modal components is identified, in which an excitation point is located with the intersection region. The diaphragm of the audio transducer includes a frame, at least one hinge, and a paddle. The paddle connects to the frame by the at least one hinge and is excited by a signal source at an excitation point to produce an acoustic signal.

20 Claims, 11 Drawing Sheets

500

POINT EXCITATION PLACEMENT IN AN AUDIO TRANSDUCER

FIELD OF THE INVENTION

The invention relates to a paddle of a diaphragm in an audio transducer.

BRIEF SUMMARY OF THE INVENTION

With one aspect of the invention, a method supports an excitation of an audio transducer. The audio transducer is excited by driving a paddle of a diaphragm. A plurality of node regions for a paddle is determined for the higher-order modal components, which correspond to resonance frequencies and have an order greater than one. An intersection region of at least two higher-order modal components is identified. An excitation point is located with the intersection region, in which the paddle is subsequently excited at the excitation point by a mechanical source.

With another aspect of the invention, node regions for the second-order modal component and the third-order modal component are determined when determining the higher-order modal components. Additional modal components may be determined.

With another aspect of the invention, at least one of the node regions is altered such as by reinforcing a portion of the paddle.

With another aspect of the invention, a diaphragm of an audio transducer includes a frame, at least one hinge, and a paddle. The paddle connects to the frame by the at least one hinge and is excited by a signal source at an excitation point to produce an acoustic signal. The excitation point is located within an intersection region of at least two higher-order modal components.

With another aspect of the invention, the at least one hinge includes two hinges that are separated by a slot region.

DETAILED DESCRIPTION OF THE INVENTION

Figure 1:
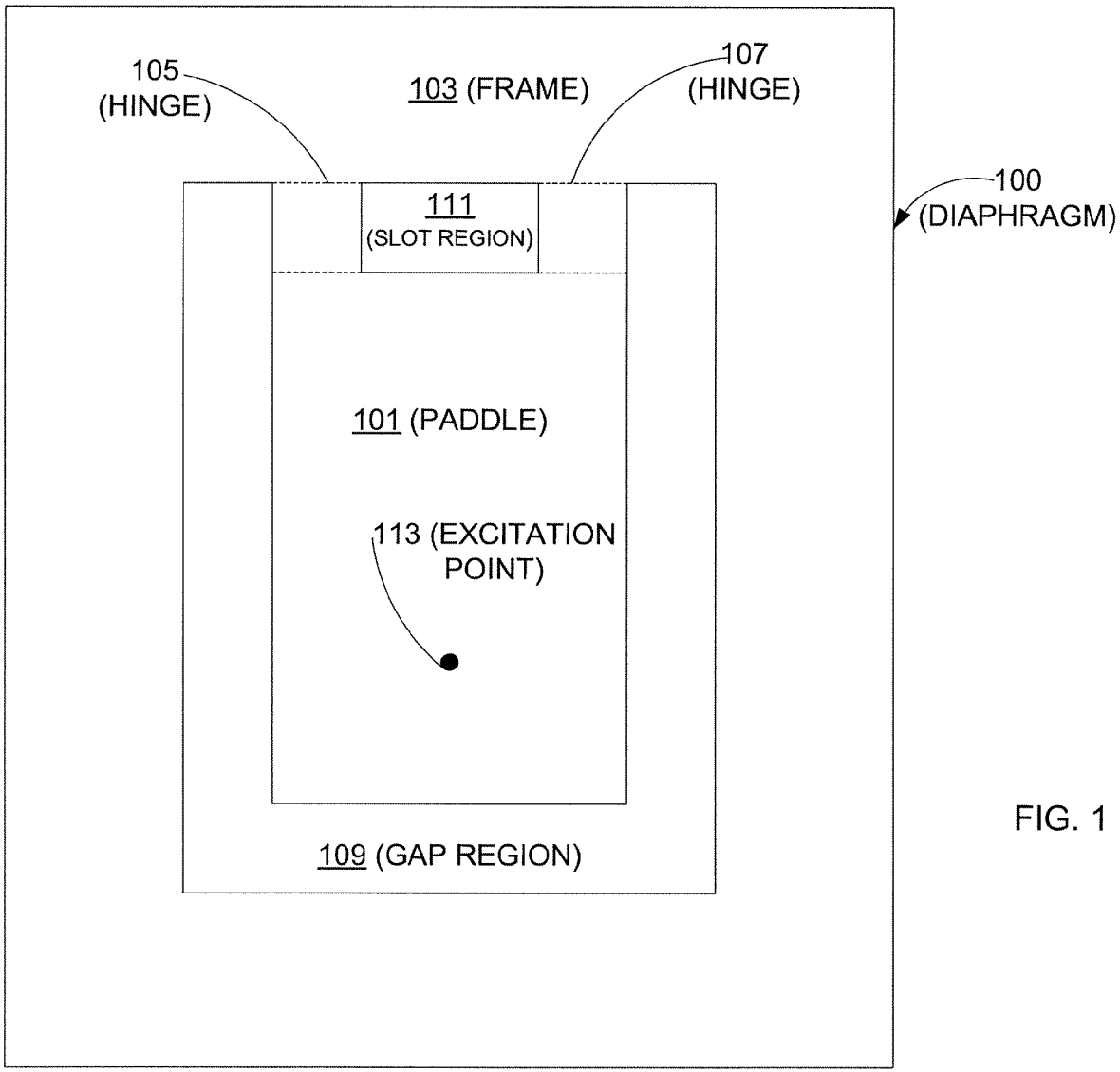
FIG. 1 shows a diaphragm of an audio transducer that is excited at an excitation point in accordance with an embodiment of the invention.

FIG. 1 shows diaphragm 100 of an audio transducer that is excited at an excitation point in accordance with an embodiment of the invention. Diaphragm 100 includes paddle 101 that is connected to frame 103 through hinges 105 and 107. Hinges 105 and 107 are separated by slot region 111. Paddle 101 is separated from frame 103 by gap region 109. In an embodiment of the invention, slot region 111 and gap region 109 are covered by a thin film of Mylar®. The film of Mylar seals the back from the front of paddle 101. Otherwise, a positive pressure created on one side may be cancelled by a negative pressure on the other side of paddle 101. Also, the film of Mylar may provide additional stiffness for paddle 101.

In an embodiment of the invention, paddle 101 is constructed of Aluminum 1100-H19 with a length L=6.76 mm, width of 3.86 mm, and a thickness of 0.002 inches. (As shown in FIG. 1, the length of paddle 101 does not include hinge sections 105 and 107. However if one includes hinge sections 105 and 107, one would add 0.254 mm to the length.)

Functionally, the purpose of paddle 101 is to displace air (or fluid) in order to generate an acoustic signal. Paddle 101 is a continuous structure with isotropic material properties, and thus does not typically behave as a lumped system. If one were designing an earphone with multiple drivers, each expected to reproduce a narrow band of frequencies, one may be able to optimize the system based upon the lumped equivalents of the drivers. However, with a single broadband driver, one must compromise the lumped (low frequency) characteristics to obtain a degree of high frequency control. This approach amounts to understanding the mechanical behavior of the dynamic driver components.

By properly locating excitation point 113 to drive paddle 101, one can improve the high frequency response of an audio transducer. For linear, dynamic excursions, the displacement of paddle 101 can be represented mathematically as the weighted summation of modal components, where the weighting constants (modal participation factors) are functions of frequency and loading and the modes are functions of the material properties, geometry, and boundary conditions. Each modal component has an associated resonance frequency and may or may not contribute to the net displacement (determined by an integration of the mode over the paddle surface). The fundamental mode contributes the largest net displacement to the cantilevered paddle response. Therefore, it is desirable to extend the influence of the fundamental modal component throughout the entire frequency range. Unfortunately, a given cantilevered paddle may have many modal components below 20 kHz. Although the displacement is a superposition of all modal components, when a structure is excited at a single modal resonance frequency the resulting displacement will be composed of only that mode (the weighting constants for the remaining modes are all zero). This observation implies that at each of the modal resonance frequencies below 20 kHz the paddle displacement consists of a single modal contribution and therefore will not have a contribution from the fundamental mode except at the fundamental resonance frequency. However, this is only true when excitation does not occur at a node region (a position on the structure that does not undergo a modal displacement at the corresponding resonance frequency).

As will be discussed, when the paddle 101 is excited at excitation point 113, where all higher-order modal components have an associated node region (which may be idealized as a node line) that passes through excitation point 113, the higher-order modal components will not contribute to the resulting paddle displacement. (A higher-order modal component has an order greater than one. The fundamental modal component has an order of one.) The contribution of higher-order modal components is typically undesirable because the resulting displacement partially cancels the displacement attributed to the fundamental modal component. One can significantly reduce the influence of higher-order modal components by carefully choosing the location of excitation point 113. Moreover, applying excitation to any position on the paddle, besides the hinge node, will excite the fundamental modal component. Vibrating in its fundamental mode, the entire paddle moves in phase.

In the exemplary embodiment shown in FIG. 1, the two lowest even-order modes (two and four) share a node region that runs through the middle of paddle 101 from hinges 105 and 107 to the tip of the free end. The second and fourth-order modal components have equal portions that vibrate out of phase and therefore integrate to zero and do not contribute to the net displacement. Excitation of these modal components, however, could potentially cause a sharp drop in response at the two resonance frequencies.

The remaining odd-order (third) modal components below 20 kHz results in the free end of the paddle vibrating out of phase and will integrate to a smaller net displacement compared to the fundamental mode. In the exemplary embodiment, the location of the second node line (the first node line is at the hinge end) of the third mode is a distance approximately 0.66×L from the hinge, where L is the paddle length. Since this point along the center line is defined by the mode shape, the location of excitation point 113 is a function of the material properties, geometry, and boundary conditions. Applying the point force to the cantilevered paddle 301 at a point along the center line having a distance 0.66L from the hinge, excites the fundamental mode, but does not excite the remaining three modes below 20 kHz. This extends the influence of the fundamental mode well above the frequency one would obtain when the point force is applied at the paddle free end (i.e., at a distance L from the hinges). Therefore, the diaphragm 300 is controlled across a wider bandwidth before the influence of higher-order modal components becomes significant.

Isolation of the fundamental vibration mode through reduction of the three remaining modal contributions below 20 kHz. Isolation is achieved by placement of the point force excitation at the intersection of the node lines of the three undesirable mode shapes. The specific location will be dependent upon geometry and material properties, but can be determined for various configurations using this technique. Computer simulation (finite element analysis) can be used to determine the location of the node lines and thus to predict the optimum excitation point.

The paddle displacement (as modeled in two dimensions) may be expressed as:

$$\eta(\varepsilon, \zeta) = \sum_{j=1}^{\infty} \alpha_j \Psi_j(\varepsilon, \zeta) \qquad \text{(EQ. 1)}$$

where $\eta$ is the paddle displacement at location $(\beta,\zeta)$, $\alpha_j$ is a modal weighing factor that is a function of frequency and loading, and $\Psi_j(\epsilon,\zeta)$ is the modal displacement for the $j^{th}$ order modal component. The modal displacement is a function of the boundary conditions and defines what is typically called the mode shape. The paddle displacement $\eta$ at a particular point $(\epsilon,\zeta)$ is the summation of the modal displacements at point $(\epsilon,\zeta)$ multiplied by the weighing factors, which may be real or complex. In ideal (no loss) materials, exciting the structure at $f=f_j$ (corresponding to the $j^{th}$ resonance frequency) will excite only the $j^{th}$ order modal component (i.e., $\eta=\alpha_j\Psi_j$), provided that the excitation point is not located on a node region. (A node region, which may be referred as a node line, identifies a region having essentially zero displacement for the corresponding modal component.)

Figure 4:
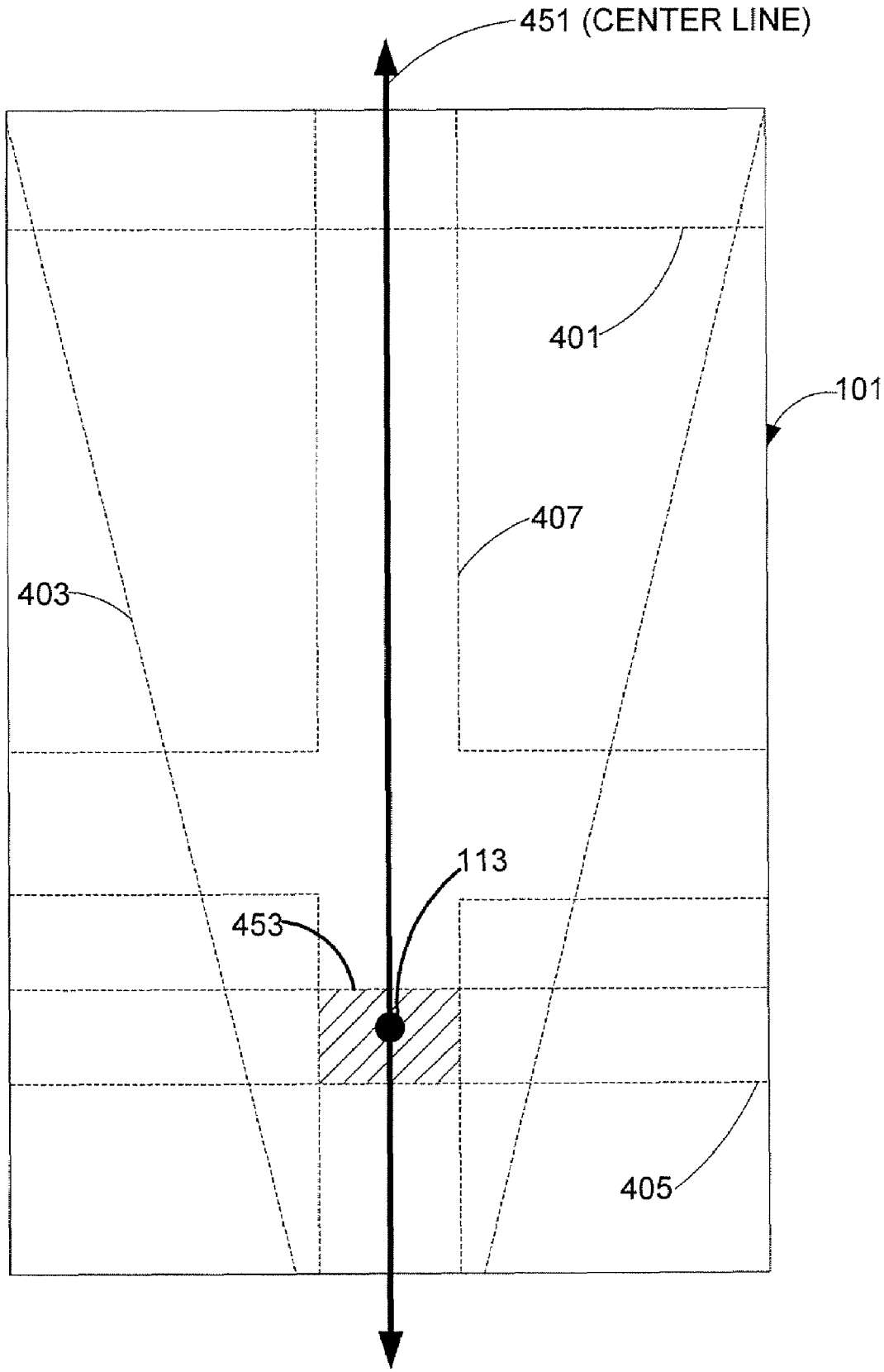
FIG. 4 depicts different node regions of a paddle, where each node region is associated with one of a plurality of modal components in accordance with an embodiment of the invention.

In real materials, internal losses (structural damping) introduces modal damping resulting in a response that is a summation of the modal components $\Psi_1$ and $\Psi_j$ ($\eta=\alpha_1\Psi_1+\alpha_j\Psi_j$), provided that the excitation point is not located within the node regions (e.g. as shown in FIG. 4) of the modal components. If the displacement for a modal component integrates to zero over paddle 101, the modal component does not contribute to the paddle response (no fluid or air displacement).

With the exemplary embodiment, excitation point 113 is located approximately 4.43 mm (i.e., 0.66L) from hinges 105 and 107. While theoretical calculations and simulated results provide an approximate location of excitation point 113, experimental results from a prototype may suggest that the location be adjusted as a result of the prototype deviating from an ideal model. For example, theoretical results are dependent on the modeling of the paddle.

Figure 2:
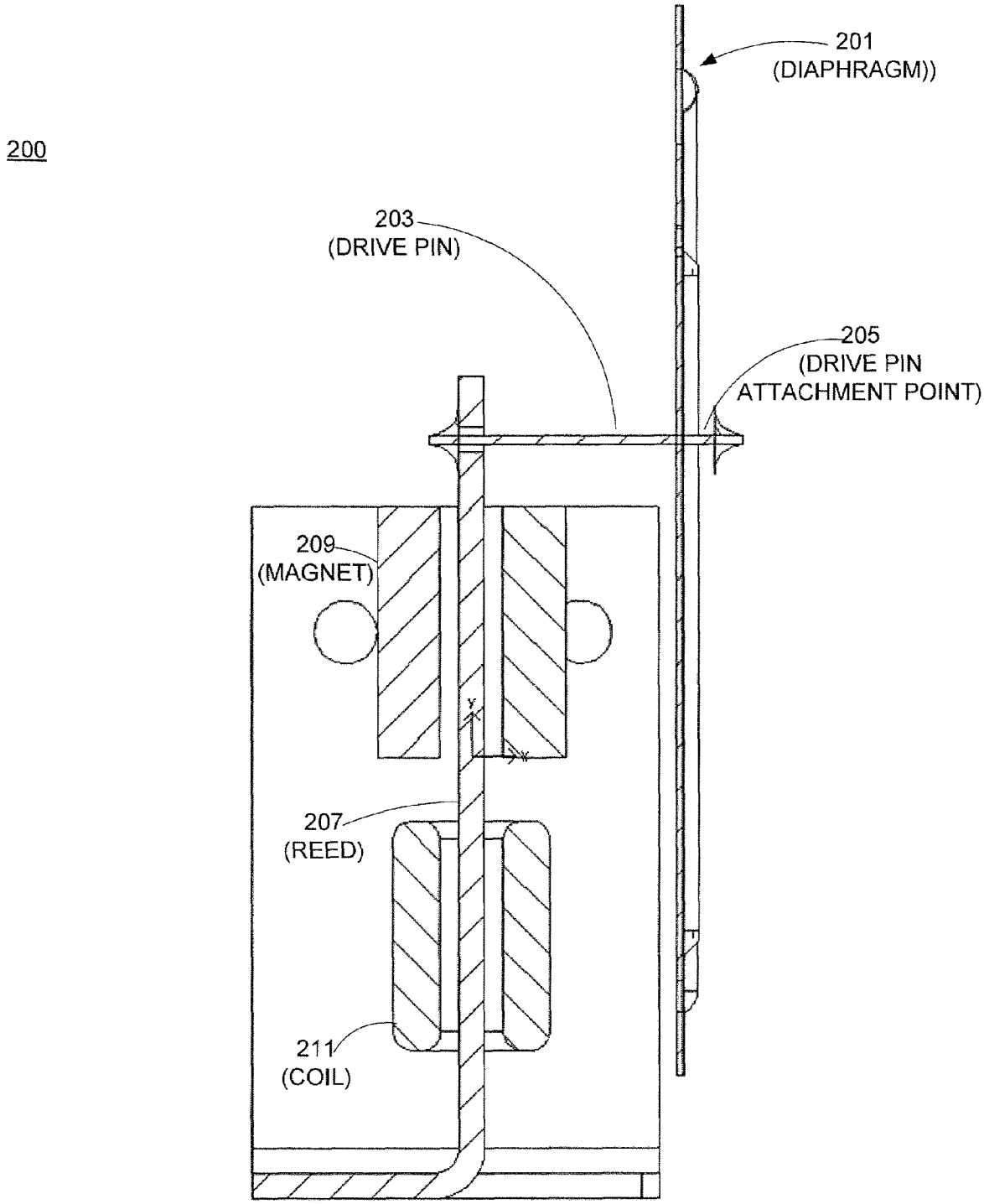
FIG. 2 shows an audio transducer in accordance with an embodiment of the invention.

FIG. 2 shows audio transducer 200 in accordance with an embodiment of the invention. Diaphragm 201 (corresponding to diaphragm 100 as shown in FIG. 1) is driven (excited) by drive pin 203 at drive pin attachment point 205. In turn, drive pin 203 is driven by reed 207 in conjunction with an armature structure (comprising magnet 209 and coil 211), which is excited by an electrical signal (typically in an audio frequency range) from electronic circuitry (not shown). In the embodiment, drive pin attachment point 205 is modeled as a single point on the surface of a paddle (corresponding to excitation point 113 as shown in FIG. 1).

FIGS. 3A-3D show a displacement analysis of paddle 301 for diaphragm 300 with gap region 309 (corresponding to paddle 101 of diaphragm 100 with gap region 109 as shown in FIG. 1). As previously discussed, with an exemplary embodiment paddle 301 has a length L=6.76 mm, a width W=3.86 mm. In simulations 351, 353, 355, and 357 the displacements are determined from finite element analysis (FEA). With FEA a computer model of paddle 301 is constructed with selected points (often referred as nodes) arranged as a grid called a mesh. In the simulations, paddle 301 is modeled with the material properties of Titanium Grade 1, although alternative simulations may utilize the material properties of aluminum 1100-H19.

With an embodiment of the invention paddle 301 is modeled with two ribs located along the length of paddle 301. The ribs typically raise the resonance frequencies of paddle 301. Raising the resonance frequencies is typically desirable because the effects of the higher-order modal components are reduced. However, adding ribs also increases the stiffness of paddle 301 and consequently tends to reduce the acoustic response of paddle 301. Note that the modal structures shown in FIGS. 3A-3D are independent of the excitation point.

Figure 3A:
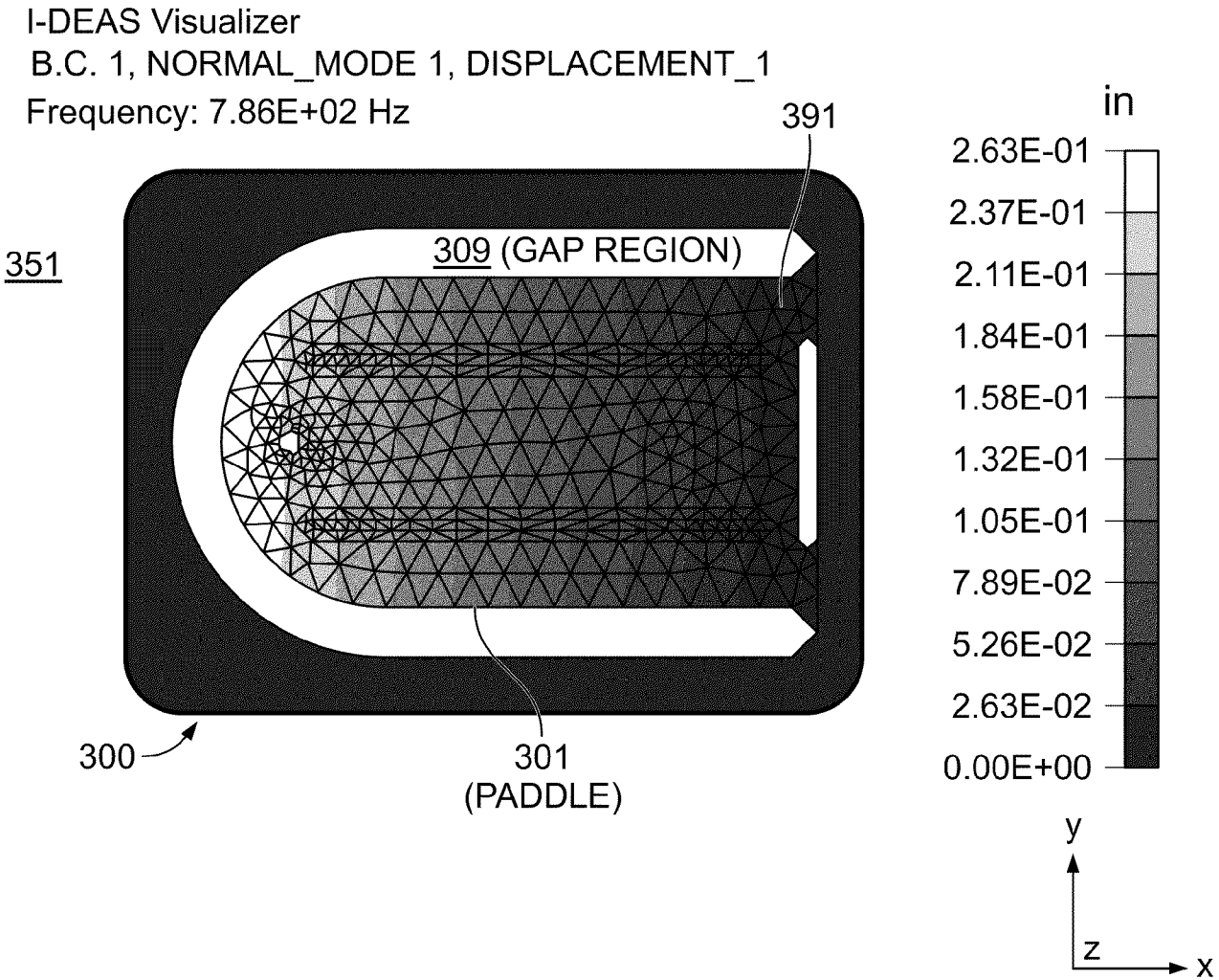
FIG. 3A a paddle of a diaphragm that is excited at a fundamental mode in accordance with an embodiment of the invention.

FIG. 3A shows simulation 351, in which paddle 301 is excited at a fundamental mode (corresponding to j=1 in EQ. 1) in accordance with an embodiment of the invention. The corresponding resonance frequency ($f_1$) approximately equals 786 Hz. As shown in FIG. 3A, the amount of displacement of paddle is shown with different shades where the darker the region, the less the displacement. (Within a black region, the displacement is approximately zero. Thus, the black regions are node regions.) Correspondingly, node region 391 (fundamental modal component) corresponds to an approximately zero displacement.

Figure 3B:
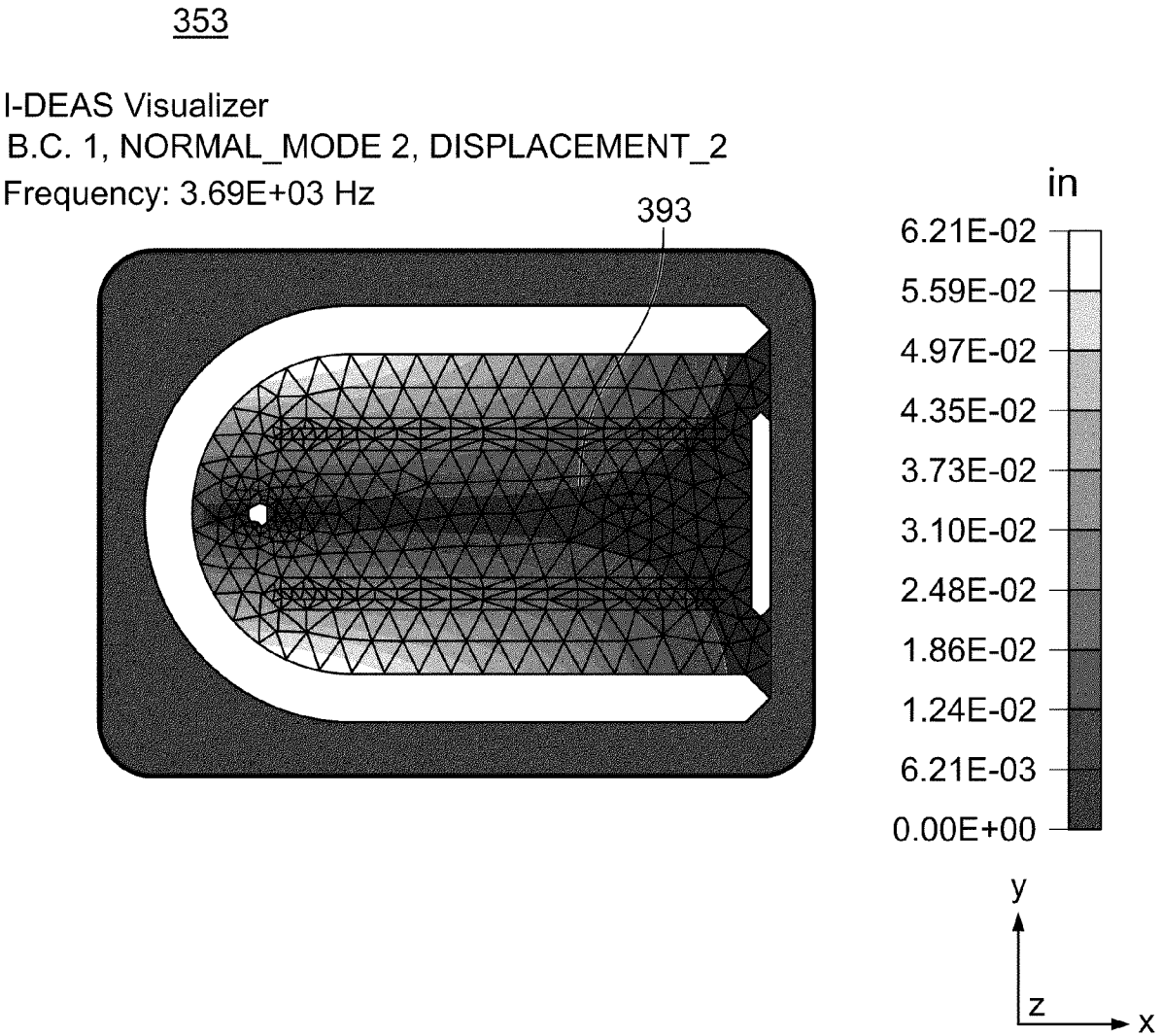
FIG. 3B a paddle of a diaphragm that is excited at a second-order mode in accordance with an embodiment of the invention.

FIG. 3B shows simulation 353, in which paddle 301 is excited at a second-order mode (corresponding to j=2 in EQ. 1) in accordance with an embodiment of the invention. The corresponding resonance frequency ($f_2$) approximately equals 3690 Hz. Node region 393 (second-order modal component) has an approximately zero displacement.

Figure 3C:
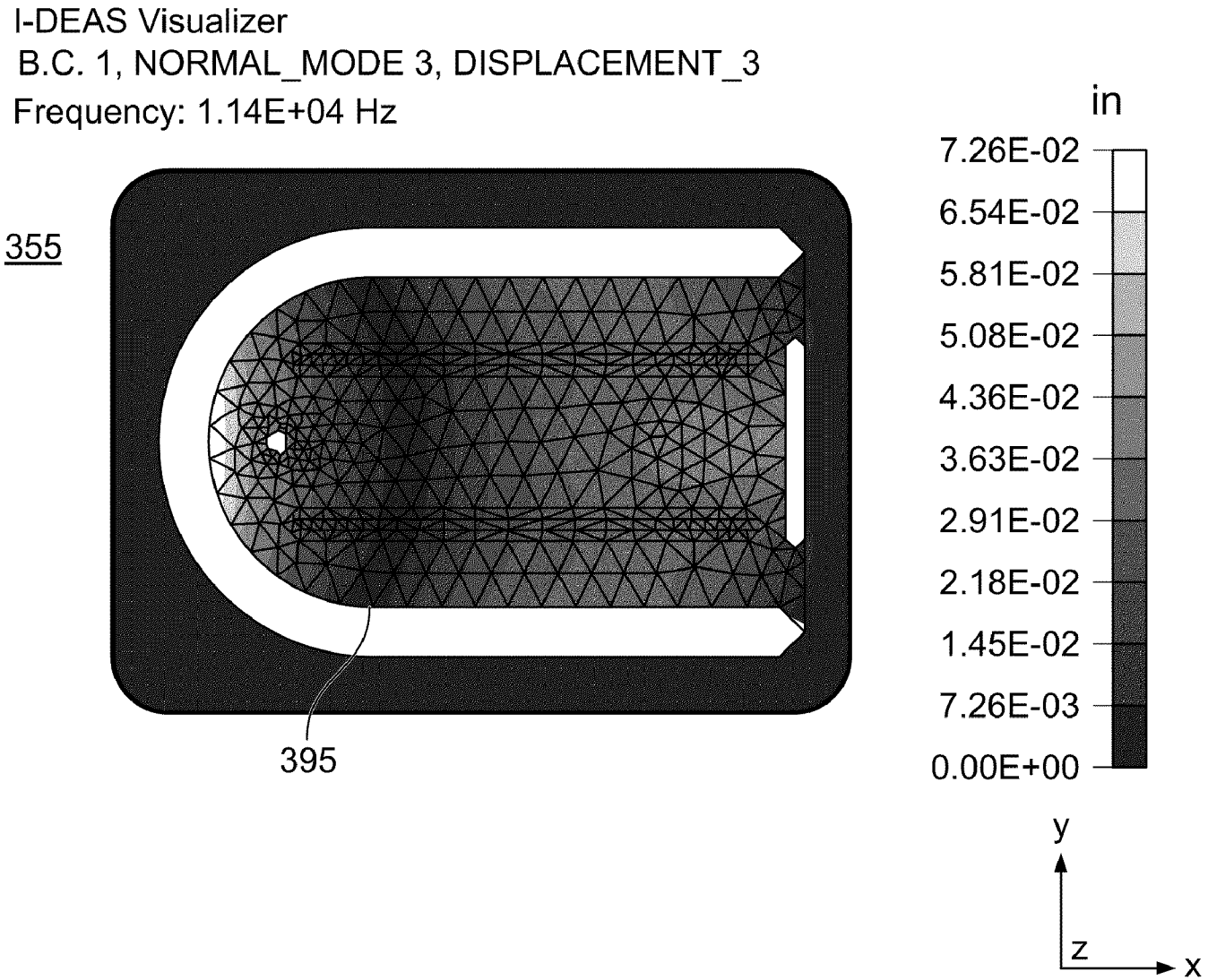
FIG. 3C a paddle of a diaphragm that is excited at a third-order mode in accordance with an embodiment of the invention.

FIG. 3C shows simulation 355, in which paddle 301 is excited at a third-order mode (corresponding to j=3) in accordance with an embodiment of the invention. The corresponding resonance frequency ($f_3$) approximately equals 11400 Hz. Node region 395 (third-order modal component) has an approximately zero displacement.

Figure 3D:
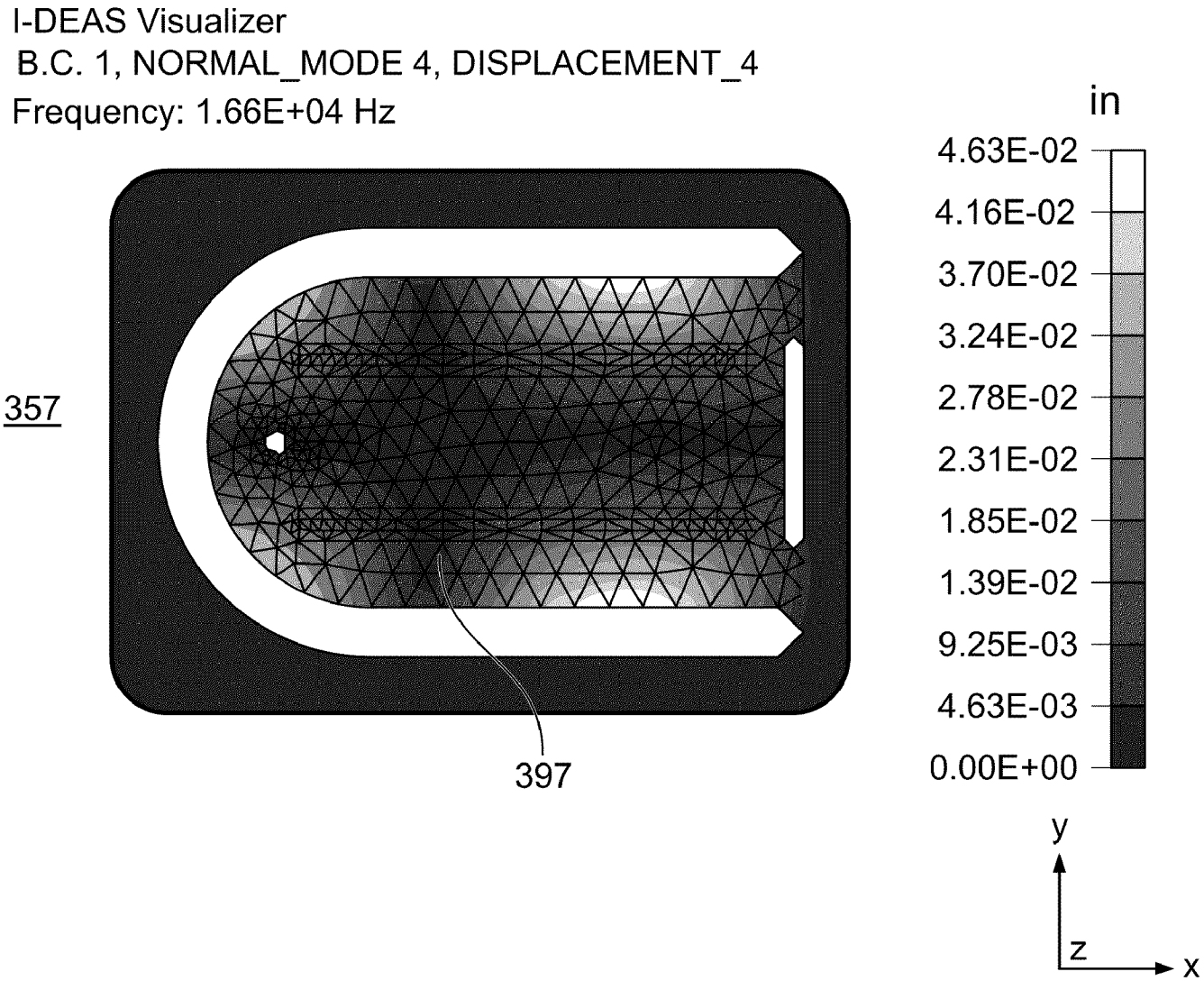
FIG. 3D a paddle of a diaphragm that is excited at a fourth-order mode in accordance with an embodiment of the invention.

FIG. 3D shows simulation 357, in which paddle 301 is excited at a fourth-order mode (corresponding to j=4) in accordance with an embodiment of the invention. The corresponding resonance frequency ($f_4$) approximately equals 16600 Hz. Node region 397 (fourth-order modal component) has an approximately zero displacement.

While FIGS. 3A-3D show simulations for the first four modal components, modal components for orders greater than four (i.e., j>4) may be determined using finite element analysis. However, typical audio applications typically consider only frequencies less than 20 KHz because of limitations of the human ear.

FIG. 4 depicts different node regions of paddle 101, where each node region is associated with one of a plurality of modal components in accordance with an embodiment of the invention. Note that FIG. 4 only depicts the different node regions. FIGS. 3A-D shows the simulated node regions for an exemplary embodiment. Node regions 401, 403, 405, and 407 correspond to node regions 391, 393, 395, and 397, respectively. Modal components having an order greater than one are termed higher-order modal components.

The even-order modal components have node regions that are symmetric to center line 451 of paddle 101. Since the excitation point 113 is typically located on center line 451, the even-order modal components are not excited. (However, embodiments of the invention enable excitation point 113 to be asymmetrically located with center line 451 within region 453 as will be discussed.) A small amount of asymmetrical loading will excite the even-order modal components; although the nearly equal contributions of positive and negative displacement results in a net displacement that is small enough to be negligible to the over-all displacement response of paddle 101.

An intersection region 453 is determined by the intersection of the higher-order modal regions. As shown in FIG. 4, intersection region 453 corresponds to the intersection of node regions 403, 405, and 407. If excitation point 113 is located within intersection region 453, the displacement that is attributed to the higher-order modal components is reduced and may be ignored in the displacement analysis of paddle 101. Consequently, the excitation of paddle 101 is essentially determined by the fundamental excitation (as shown in FIG. 3A). In the exemplary embodiment, excitation point 113 is approximately located at 0.66L (where L is the length of paddle 101) from the hinges 105 and 107 along center line 451.

While paddle 101 may be analyzed using finite element analysis as described above, one may determine the location of excitation point 113 using other approaches. For example, neglecting the acoustical reactionary loading of paddle 101, the paddle displacement may be approximated using the analysis as modeled in FIG. 6 as will be discussed. Also, one may measure the displacement of paddle 101 for different modal components in order to determine the intersection region. Measuring the displacement to determine the placement of excitation point 113 is empirical and is typically time consuming. Moreover, one must repeat the measurements when paddle 101 is altered (e.g., changing the paddle shape or adding ribs.)

Figure 5:
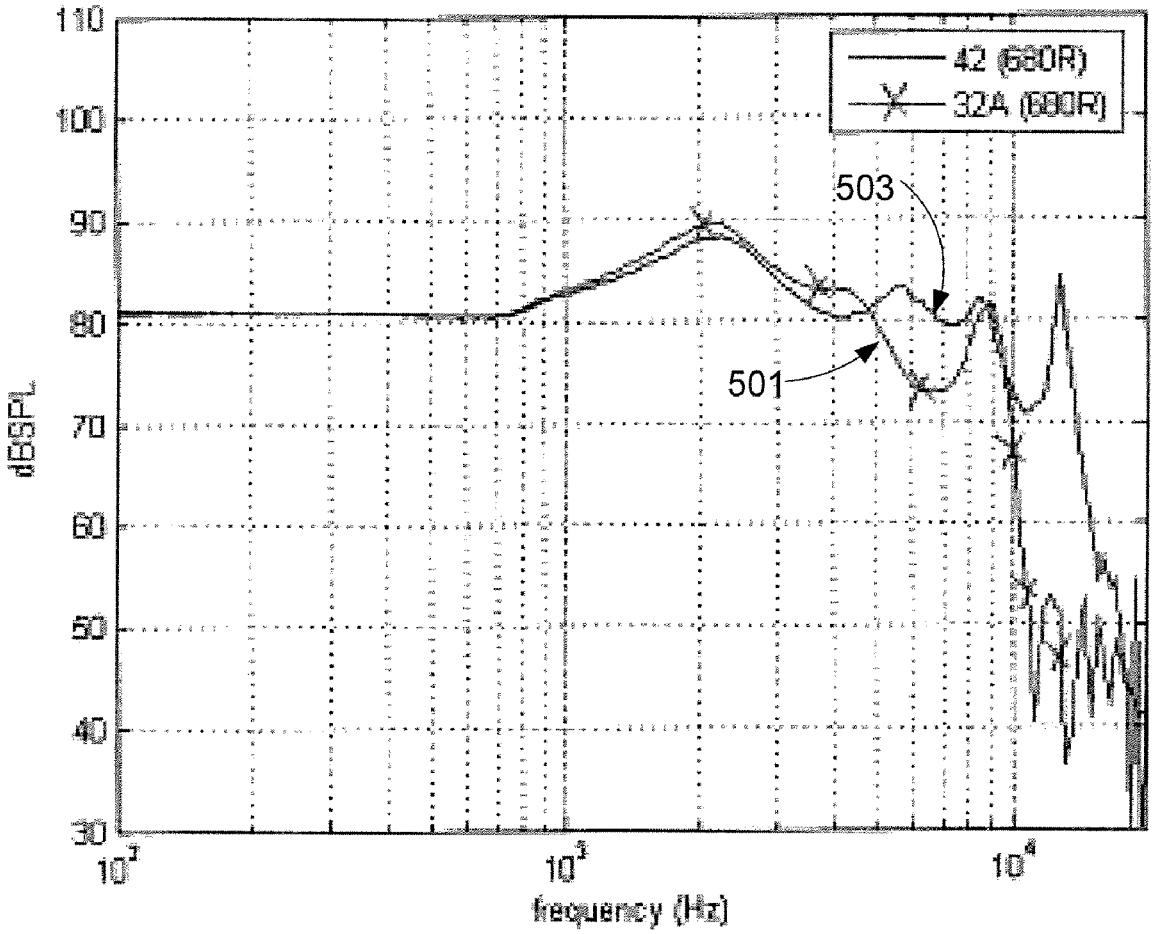
FIG. 5 shows a measured earphone response in accordance with an embodiment of the invention.

FIG. 5 shows measured earphone response 500 in accordance with an embodiment of the invention. Frequency response 501 shows the response for paddle 301 where the excitation point is located approximately at the end of paddle 301 (i.e., x=0.90L), while frequency response 503 shows the response where the excitation point is located at approximately x=0.66L. Measured earphone response 500 suggests that the frequency response is extended when the excitation point is located within intersection region 453. In particular, the contribution from the third-order modal component is substantially reduced in accordance with the above discussion.

Figure 6:
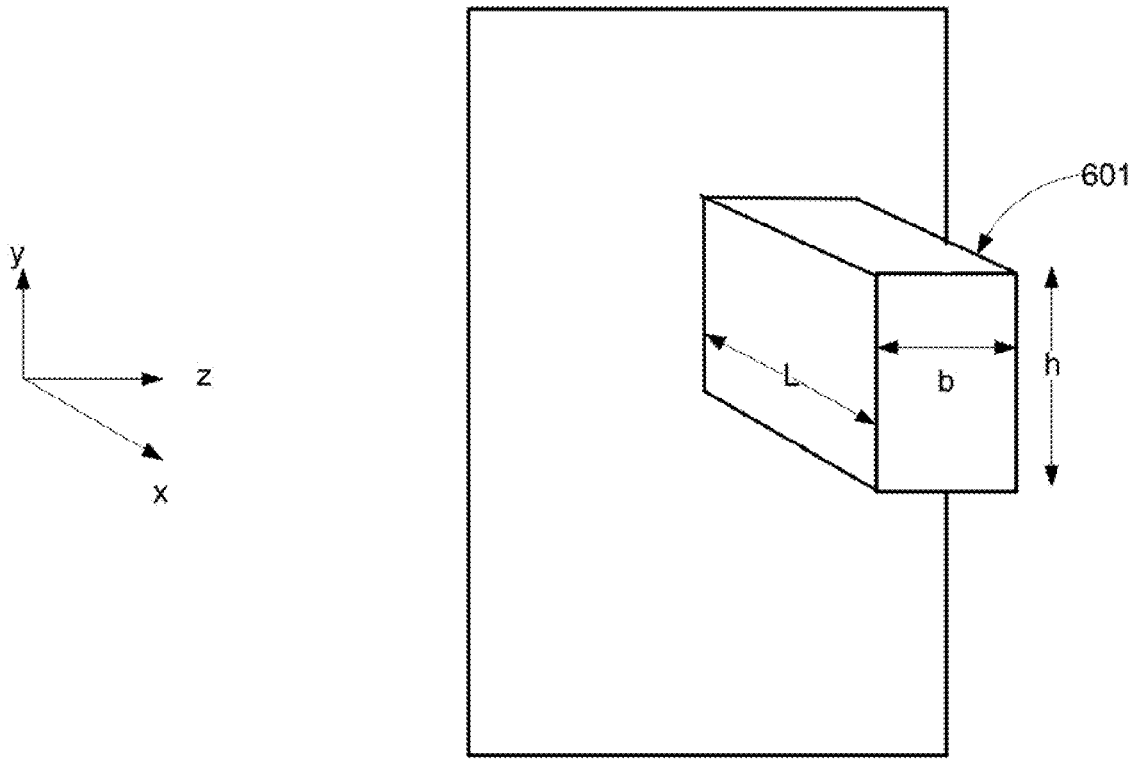
FIG. 6 shows a modeling of a paddle in accordance with an embodiment of the invention.

FIG. 6 shows a modeling of paddle 601 in accordance with an embodiment of the invention. With an embodiment of the invention, paddle 601 may be analyzed in order to determine the location of an excitation point to reduce higher-order modal components, e.g., the third order modal component. Paddle 601 is modeled as a cantilevered beam having a length L, a constant width b, and a constant thickness h. Paddle 601, as modeled as a cantilevered beam, has a mode shape given by:

$$\Psi_j(x)=C(\lambda_j x)-\gamma_j D(\lambda_j x) \quad \text{(EQ. 2)}$$

The characteristic equation, which determines the natural frequencies of the cantilevered beam, is obtained by:

$$\cos h(\lambda_j L)\times\cos(\lambda_j L)+1=0 \quad \text{(EQ. 3)}$$

The modal weighing factors are determined from:

$$\alpha_j = \frac{\int_0^L q(x)\Psi_j(x)dx}{(EI\lambda_j^4-\rho A\omega^2)\int_0^L \Psi_j^2(x)dx} \quad \text{(EQ. 4)}$$

where q(x) is the force as a function of x, E is the Young's Modulus of the material, I is the area moment, ρ is the material density, and A is the cross sectional area. Note that $\alpha_j$ is a function of ω but is a constant because it is not a function of the position x. Because the cantilevered beam has a constant rectangular cross section of width b and thickness h, the area moment I is given by:

$$I = \frac{bh^3}{12} \quad \text{(EQ. 5)}$$

Consequently, modal resonance frequency $\omega_j$ is given by:

$$\omega_j = \lambda_j^2\sqrt{\frac{EI}{\rho A}} \quad \text{(EQ. 6)}$$

In order to locate an excitation point that reduces a higher-order modal component, one can vary x, where q(x) is a force applied at a single point x' along the cantilevered beam, so that $\alpha_j$ is essentially zero in order to eliminate the contribution of the $j^{th}$ modal component. If the excitation point is located at the center line of the paddle, the displacement contribution of the even-order modal components is essentially zero. In such a case, the third-order modal component has the largest effect of the higher-order modal components. Consequently, one varies the location of the excitation point along the length of the paddle in order to reduce $\alpha_3$ (the modal weighing factor of the third-order modal component).

Figure 7:
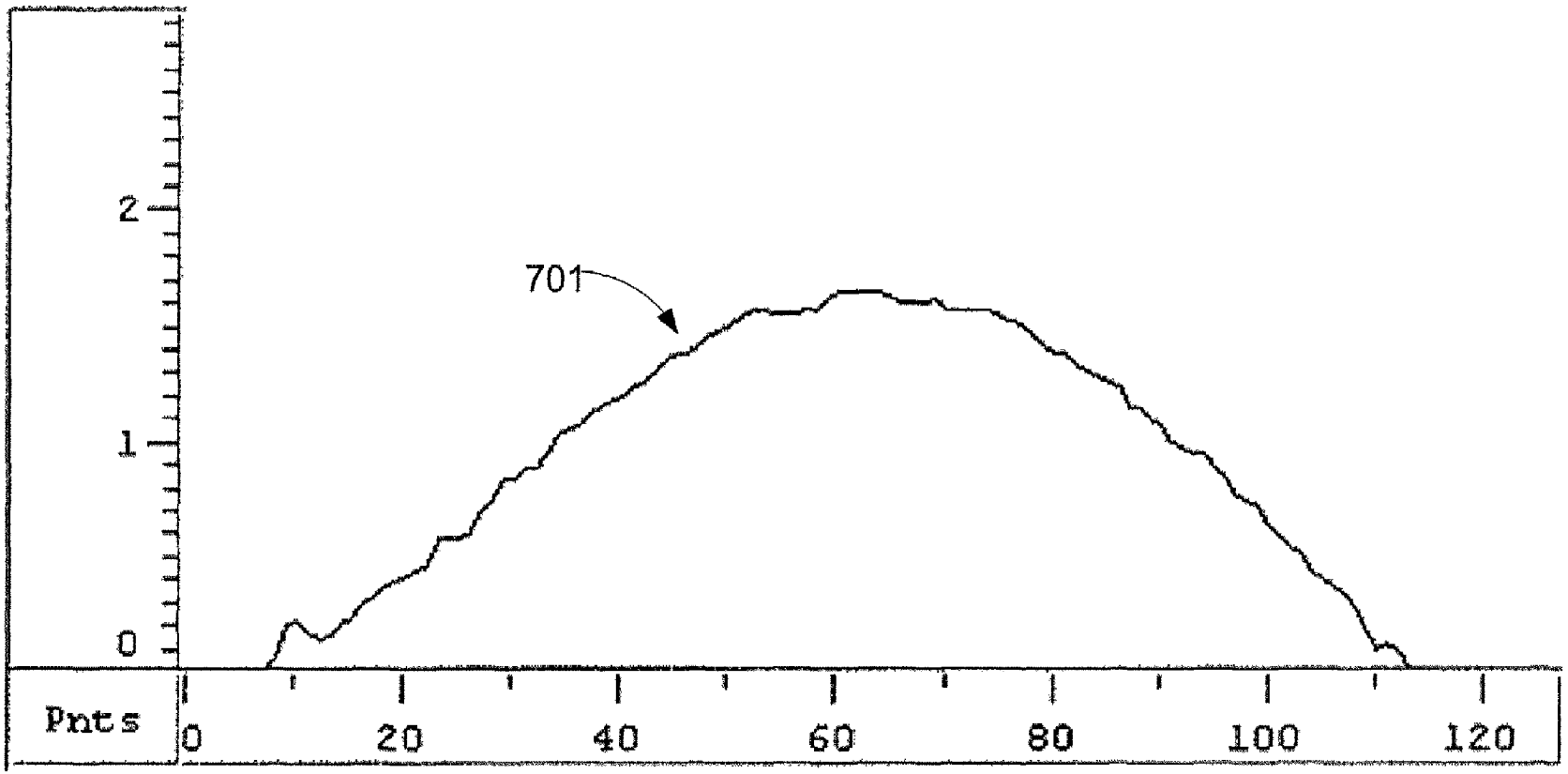
FIG. 7 shows a measured paddle velocity for a prototype in accordance with an embodiment of the invention.

FIG. 7 shows paddle velocity plot 701 for a first paddle prototype (not shown) measured at 7400 Hz in accordance with an embodiment of the invention. (The paddle velocity is measured in mm/sec as a function of the position along the paddle.) The x axis only shows the number of the measurement points. With the first paddle prototype, the excitation point is located near the end of the paddle (x=0.90L), where the hinge is located at point 112 on the x axis. One observes that a contribution from the third-order modal component with a lesser contribution from the fundamental (first) order modal component. The contribution from the third-order modal component increases with the excitation frequency until the excitation frequency equals the third resonance frequency $f_3$, which approximately equals 11400 Hz.

Figure 8:
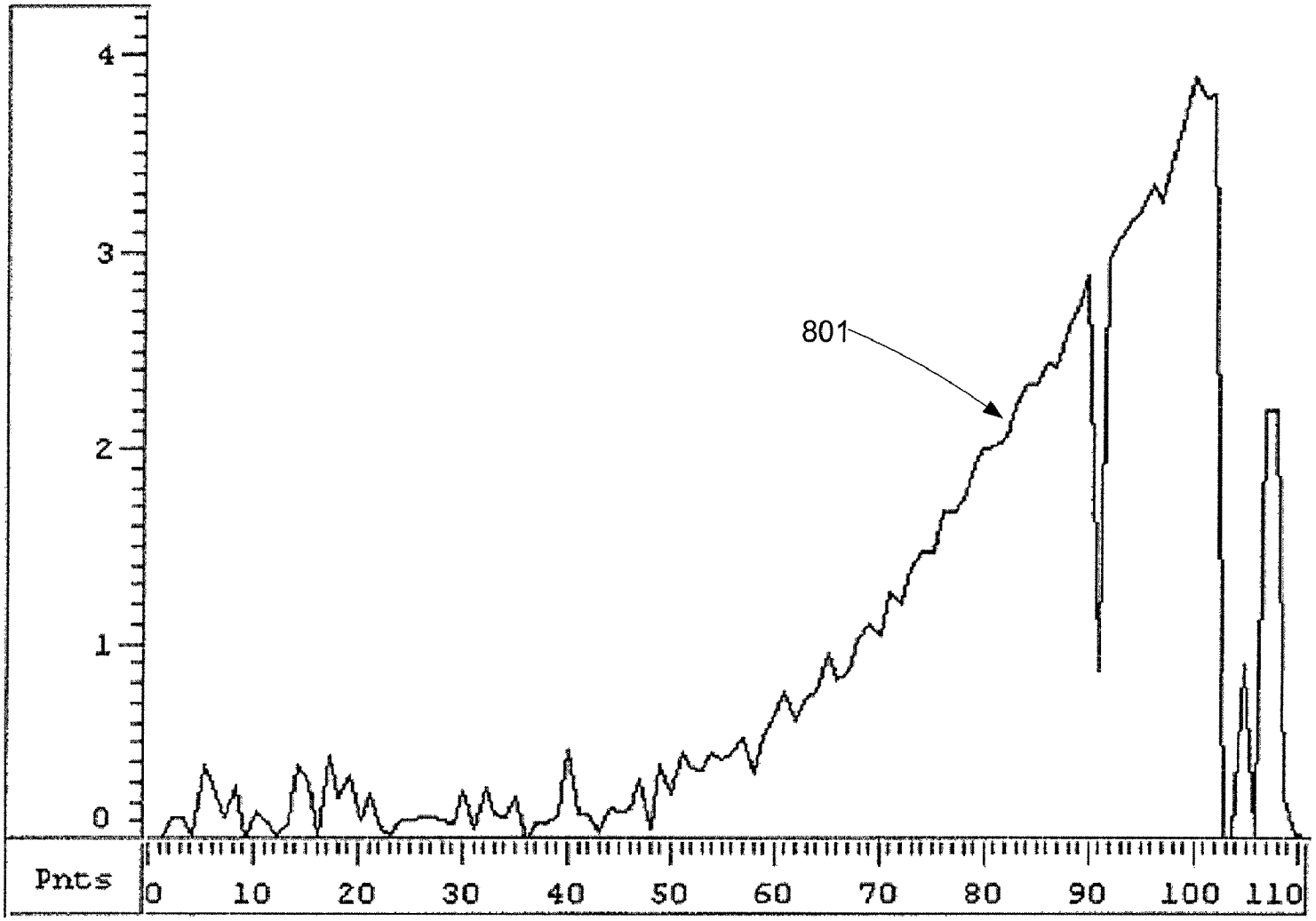
FIG. 8 shows a measured paddle velocity for a prototype in accordance with an embodiment of the invention.

FIG. 8 shows paddle velocity plot 801 for a second paddle prototype (not shown) measured at 7400 Hz in accordance with an embodiment of the invention. The excitation point is located at approximately 0.66L from the hinge portion of the diaphragm. Compared with paddle velocity plot 701, the displacement contribution from the third-order modal component is negligible while the movement of the paddle is dominated by the fundamental mode shape. The experimental results shown in FIGS. 7 and 8 suggest that the placement of the excitation away from the paddle end, as discussed above, substantially reduces the contribution from the higher-order modal components and consequently improves the frequency response of an acoustic device.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

The invention claimed is:

1. A method for exciting an audio transducer, comprising:

(a) determining a plurality of node regions of a paddle, each node region associated with one of a plurality of higher-order modal components, the higher-order modal component having an order greater than one;

(b) identifying a spatial intersection region of node regions for at least two higher-order modal components, wherein each node region is characterized by an essentially zero displacement for a corresponding modal component of the at least two higher-order modal components;

(c) locating an excitation point within the spatial intersection region; and (d) exciting the paddle at the excitation point by a signal source to produce an acoustic signal.

2. The method of claim 1, wherein (a) comprises:

(a)(i) determining a second-order modal component and a third-order modal component; and wherein the at least two higher-order modal components comprises the second-order modal component and the third-order modal component.

3. The method of claim 2, wherein the at least two higher-order modal components further comprises another modal component.

4. The method of claim 1, further comprising:

(e) altering at least one of the plurality of node regions.

5. The method of claim 4, wherein (e) comprises:

(e)(i) reinforcing a portion of the paddle.

6. The method of claim 1, wherein (a) comprises:

(a)(i) analyzing the paddle with finite element analysis.

7. The method of claim 1, wherein (a) comprises:

(a)(i) modeling the paddle as a cantilever.

8. The method of claim 1, wherein (a) comprises:

(a)(i) exciting the paddle at an excitation frequency;

(a)(ii) obtaining a velocity plot along a spatial dimension for the paddle; and (a)(iii) repeating (a)(i)-(a)(ii) at a different frequency.

9. A diaphragm that is excited to produce an acoustic signal in an audio transducer, comprising:

a frame;

at least one hinge; and a paddle connecting to the frame by the at least one hinge, the paddle being excited by a signal source at an excitation point to produce the acoustic signal, the excitation point being located within a spatial intersection region of node regions for at least two higher-order modal components, wherein each node region is characterized by an essentially zero displacement for a corresponding modal component of the at least two higher-order modal components.

10. The diaphragm of claim 9, wherein the at least one hinge comprises two hinges that are separated by a slot region.

11. The diaphragm of claim 9, wherein the paddle includes a reinforced portion.

12. The diaphragm of claim 11, wherein the reinforced portion comprises a rib structure.

13. The diaphragm of claim 9, wherein the spatial intersection region of node region includes a second-order modal component and a third-order modal component.

14. The diaphragm of claim 13, wherein the spatial intersection region of node regions includes another higher-order modal component.

15. The diaphragm of claim 9, wherein the excitation point is located along a center line of the paddle approximately 0.66L from the at least one hinge and wherein L is a length of the paddle.

16. The diaphragm of claim 9, further comprising a gap region separating the paddle from the frame.

17. The diaphragm of claim 16, wherein the gap region is covered by a sheet of material.

18. An audio transducer that provides an acoustic signal, comprising:

an excitation unit driven by an electrical signal;

a linkage excited by the excitation unit to produce a movement; and a diaphragm coupled to the linkage at an excitation point and excited by the linkage as the linkage moves, the diaphragm including:

a frame;

at least one hinge; and a paddle connecting to the frame by the at least one hinge, the paddle being excited by the linkage at the excitation point to produce the acoustic signal, the excitation point being located within a spatial intersection region of node regions for at least two higher-order modal components, wherein each node region is characterized by an essentially zero displacement for a corresponding modal component of the at least two higher-order modal components.

19. The audio transducer of claim 18, wherein the spatial intersection region of node regions includes a second-order modal component and a third-order modal component.

20. The audio transducer of claim 19, wherein the spatial intersection region of node regions includes another higher-order modal component.

* * * * *